United States Patent [19]

Sekigawa et al.

[11] 4,345,372

[45] Aug. 24, 1982

[54] METHOD OF PRODUCING A MULTICONTACT SPRING

[75] Inventors: Kenji Sekigawa; Takeshi Sato; Mikio Motizuki, all of Nagano, Japan

[73] Assignee: Shinko Electric Industries Co., Ltd., Nagano, Japan

[21] Appl. No.: 88,631

[22] Filed: Oct. 26, 1979

[30] Foreign Application Priority Data

Oct. 31, 1978 [JP] Japan ..... 53-134071

[51] Int. Cl.[3] ..... H01R 43/04

[52] U.S. Cl. ..... 29/874; 29/882

[58] Field of Search ..... 29/882, 879, 413, 414, 29/874; 338/202; 200/246, 283

[56] References Cited

U.S. PATENT DOCUMENTS 3,488,842 1/1970 Rochette et al. ..... 338/202 X
3,579,822 5/1971 Dieterich ..... 29/879
3,755,892 9/1973 Dieterich ..... 29/882
3,936,624 2/1976 Andersen et al. ..... 29/882 X

FOREIGN PATENT DOCUMENTS 1003775 9/1965 United Kingdom ..... 29/874

*Primary Examiner*—Francis S. Husar
*Assistant Examiner*—Carl J. Arbes
*Attorney, Agent, or Firm*—Staas & Halsey

[57] ABSTRACT

A multicontact spring having a number of contacts per unit width is produced by press working. A metal tape for a spring is blanked to form a blank. The blank is pressed to make linear dents and, then, cutting of each one of the linear dents is performed. The blank having the cut parts is deformed to form it into a suitable shape for contact points. The thus produced multicontact spring has cut and deformed parts, i.e. contacts, having no free ends. Thereafter, if desired, one end part of the blank is cut to form another type multicontact spring having contacts which have free ends, respectively.

5 Claims, 14 Drawing Figures

METHOD OF PRODUCING A MULTICONTACT SPRING

BACKGROUND OF THE INVENTION

1. Field of the Invention

The present invention relates to springs having contacts which are used as contacting parts of variable resistors, trimmers, motors, cameras, potentiometers, etc., and more particularly to a method of producing a spring having multicontacts (hereinafter referred to as "a multicontact spring").

2. Description of the Prior Art

For a contacting spring to have a high reliability, it is generally necessary that it have a plurality of contacts. Miniaturization of electrical apparatus using a contacting spring requires a corresponding decrease in the size of the contacting spring. Accordingly, for miniaturization of electrical apparatus it is necessary to increase the density of the number of contacts per unit width of a spring and to minimize the contact spacing (i.e. distance between adjacent edges of two adjacent contacts). For example, there is a demand to produce a multicontact spring which is 1 mm in width and has five contacts which are less than 0.2 mm in width, respectively. However, such a multicontact spring has not been successfully produced by conventional methods, i.e., a photo etching method and a blanking method.

In accordance with the conventional photo etching method, a multicontact spring is produced by the steps of:

coating both surfaces of a spring blank with a photo resist;

shining light on the photo resist through a negative pattern film;

removing parts of the resist;

etching the parts of the spring blank which are not coated with the resist, and;

removing the remaining resist. An illustration of the thus produced multicontact spring can be seen in FIGS. 1A and 1B. The contact spacing of the multicontact spring produced by the above mentioned photo etching method is usually limited by the thickness of the spring, in view of the so called side etching (i.e. etching of a part under the resist). Furthermore, it is difficult to make the contact spacing less than 0.1 mm. Finally, since each of the corner edges 1 of a contact is formed in an acute angle, as illustrated in FIG. 1B, the corner edges 1 may damage a contact surface of a member which comes in touch with the multicontact spring. In a case where a multicontact spring is produced by the photo etching method disclosed in the Japanese Patent Publication No. 52-46889, the spring material is a precious metal alloy (i.e. platinum and silver alloy), so that the etching rate is small. In this regard, it is possible, after photo etching a copper-base alloy blank, to plate a precious metal alloy for the contact material on the copper-base alloy spring, but the production process of such a multi-contact spring is rather complicated. Accordingly, such a photo etching method of producing a multicontact spring is not suitable for mass production.

An illustration of a multicontact spring produced by the conventional blanking method (i.e. a press working method) can be seen in FIGS. 2A and 2B. In the case of the conventional blanking method, the contact spacing of the produced multicontact spring is limited to approximately 0.2 mm by the conventional die producing technique. Furthermore the contact spacing increases as the thickness of the spring material increases. Finally, as the width of a contact decreases, an undesirable deformation (e.g. twisting or curling) may occur in the contact.

It is also known that the above mentioned multicontact spring having a plurality of contacts per unit width of the spring can be produced by a welding method. An illustration of the multicontact spring, which is a so called multi-wire spring brush, produced by this method can be seen in FIGS. 3A, 3B and 3C. In accordance with the welding method, the multicontact spring is produced by the steps of arranging a number of wires 2 contacting parts between a base plate 3 and an additional plate 4, welding the wires 2 and the plates 3 and 4 by spot welding or soldering, and then, cutting the wires 2. As the diameter of each of the wires used as contacts decreases, the density of the number of wires per one spring can be increased, but more uniform diameters and higher quality wires are required. Furthermore, as the number of the wires increases, it is possible to easily generate a small difference in the shapes of the welded wires, so that the quality of the multicontact springs produced by the welding method is not stable.

SUMMARY OF THE INVENTION

An object of the present invention is to provide a method of producing a multicontact spring having a high density of contacts.

Another object of the present invention is to provide a suitable method for mass production of the above mentioned multicontact springs.

A further object of the present invention is to produce multicontact springs having stable quality by using a press machine.

The above and other objects of the present invention are attained by a method of producing a multicontact spring which comprises the steps of: blanking a part of a metal tape for a spring to form a blank; pressing the blank to make linear dents therein which are parallel to each other and do not reach the ends of the blank; dividing the linear dents part of the blank by repeating a press working for cutting one of the linear dents, and; pressing the divided parts of the blank into suitable shapes for contacts.

DETAILED DESCRIPTION OF THE PREFERRED EMBODIMENTS

Firstly, a blank for a multicontact spring is formed by blanking a metal sheet or a metal tape. The metal sheet or tape is made of contact materials or a copper-base alloy covered with a precious metal. The contact materials include copper, silver, and gold and their alloys, platinum and palladium alloys, and certain mixtures of metals.

Figure 1A:
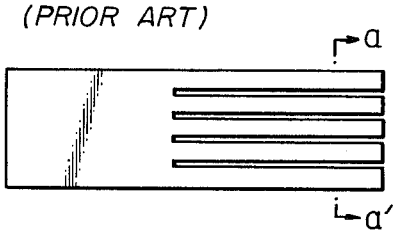
Fig. 1A (PRIOR ART)
FIG. 1A is a plan view of a multicontact spring of the prior art.
Figure 2A:
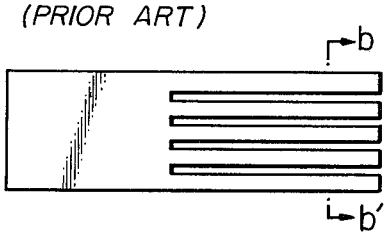
Fig. 2A (PRIOR ART)
FIG. 2A is a plan view of a multicontact spring of the prior art.
Figure 1B:
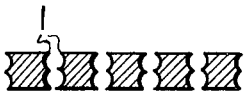
Fig. 1B (PRIOR ART)
FIG. 1B is a sectional view taken along the line a—a' of FIG. 1A.
Figure 2B:
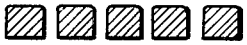
Fig. 2B (PRIOR ART)
FIG. 2B is a sectional view taken along the line b—b' of FIG. 2A.
Figure 3A:
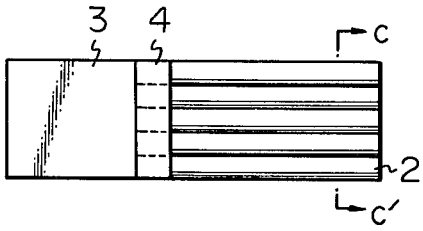
Fig. 3A (PRIOR ART)
FIG. 3A is a plan view of a multicontact spring of the prior art.
Figure 3B:
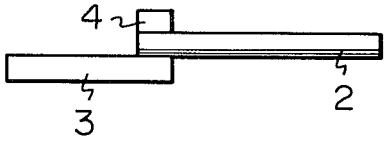
Fig. 3B (PRIOR ART)
FIG. 3B is a side view of FIG. 3A.
Figure 3C:
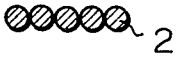
Fig. 3C (PRIOR ART)
FIG. 3C is a sectional view taken along the line c—c' of FIG. 3A.
Figure 4A:
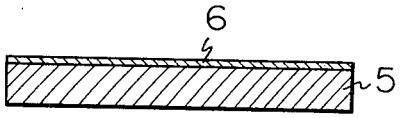
FIGS. 4A through 4C are cross-sectional views of the multicontact spring of the present invention.
Figure 4B:
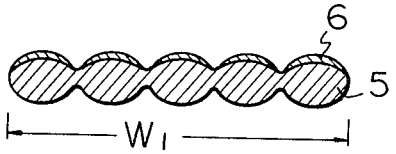

In the case of FIG. 4A, a blank consists of a base plate 5 of phosphor bronze for a spring and a cladding layer 6 of gold. The blank is pressed with a die to make linear dents therein e.g., as illustrated in FIG. 4B. The dents are parallel to each other and are straight lines, circular arcs or curves. Furthermore, each of the dents has gently slope corners in its cross section. Since one of objects of making the dents is to prevent damage to a contact surface of an opposite member which is touched with a completed multicontact spring, no sharp corner edges should be produced by the press working for making the dents. Another object of making the dents is to prevent flash and burr from occurring, and to decrease the shearing force which is needed for cutting operations. None of the dents reach the ends of the blank. The dents may be made on one of the two surfaces of the blank, for example, on a clad surface of the blank. Also, the dents may be made in a deformation area for contact points.

Figure 4C:
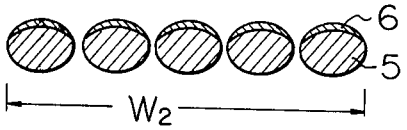

Then, predetermined parts of the blank are divided by repeating a press working for cutting one of the linear dents or a predetermined linear part including one of the linear dents without scraps, as illustrated in FIG. 4C. According to the present invention, the contact spacing of the divided parts of the blank is from 0.01 to 0.05 mm. In the case of FIGS. 4B and 4C, the width $W_2$ (FIG. 4C) is 0.04~0.2 mm longer than the width $W_1$ (FIG. 4B) of the blank.

Figure 5:
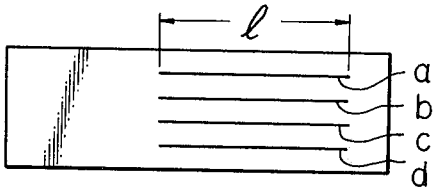
FIG. 5 is a plan view of the blank of the present invention.

FIG. 5 is a schematic plan view of a blank having five divided parts. The lines a, b, c and d in FIG. 5 represent cut parts of the blank and the length l represents the cut distance of each of lines a, b, c and d. The cut parts correspond to the above-mentioned linear dents, respectively, the above-mentioned cutting operations are repeated in the alphabetical order (a, b, c and d) shown in FIG. 5. Furthermore, it is possible to make the width of each divided part (contact) 0.2 mm in the case of the thickness of the blank being 0.07~0.27 mm.

Figure 6:
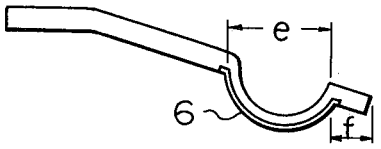
FIG. 6 is a side elevational view of the present invention after an area is deformed for providing contact points.

The blank having the divided parts is pressed to deform it into a suitable shape for contact points, as illustrated in FIG. 6. FIG. 6 is a schematic side view of a multicontact spring produced by the method of the present invention. in FIG. 6, the part e represents a deformed area for contact points and a cladding gold layer 6 serves as a contact material. Accordingly, both ends of each of the contacts are connected to each other through the end parts of the multicontact spring. It is convenient to cut an end part of the multicontact spring, represented by f in FIG. 6, so that each of the divided parts (contacts) has a free end. If such cutting operation is carried out prior to the deformation operation for forming the contact points, an undesirable deformation (e.g. twisting or curling) may occur in the contacts.

Figure 7A:
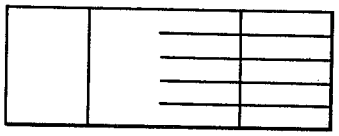
FIG. 7A is a plan view of a modified embodiment of the present invention with end parts removed.
Figure 7B:
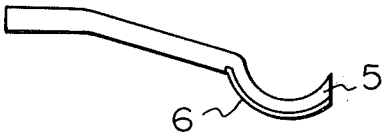
FIG. 7B is a side elevational view of the embodiment of FIG. 7A.

FIG. 7A is a schematic plan view of a multicontact spring with end parts removed by cutting. FIG. 7B is a schematic side view of FIG. 7A.

It is possible to easily carry out the production of multicontact springs in accordance with the proposed method by using a progressive die.

EXAMPLE

A metal tape 15 mm in width and 0.1 mm in thickness was used as a starting material. The metal tape was made of a spring material of phosphor bronze with a clad gold layer. The metal tape was blanked to form a blank 1 mm in width. The blank was pressed to make four linear dents 6.5 mm in length. The minimum thickness of the blank at each of the dents was 0.03 mm. A press working for cutting the blank at a predetermined part including one of the dents was repeated four times. The cutting length was 6.1 mm. Then, the blank having the cut parts was pressed into a suitable shape for contact points as illustrated in FIG. 6. Finally, an end part of the blank was cut to complete a multicontact spring. The multicontact spring had five contacts, each of which was 0.2 mm in width.

Although the present invention has been described with reference to the preferred embodiments and an example of the present invention, it will be understood by those skilled in the art that modification of the embodiments may be carried out without departing from the spirit and scope of the invention. For example, it is possible to form a multicontact spring in various desired shapes according to the method of the present invention.

What we claim is:

1. A method of producing a multicontact spring comprising the steps of:

blanking a metal tape to form a blank for the multicontact spring;

pressing said blank to make linear dents therein which are parallel to each other and correspond to contacting areas of said multicontact spring;

dividing said blank by repeating a press working for cutting clear through said blank a predetermined linear part which includes each one of said linear dents and does not include the end parts of said blank; and pressing said divided parts of said blank into suitable shapes for providing contact points.

2. A method according to claim 1 comprising a step of cutting an end part of said blank by press working, after said pressing step of the divided parts of the blank, so that each of said divided parts of the blank having said suitable shape has a free end.

3. A method according to claim 1, wherein the contact spacing of said multicontact spring is from 0.01 to 0.05 mm.

4. A method of producing a device having multicontacts comprising the following steps:

obtaining a suitable blank of spring metal from a sheet of metal;

pressing said blank in a central area thereof to make linear dents therein which do not reach the ends of said blank;

cutting completely through said blank at each of said dents thus dividing said central area into a plurality of parts and leaving connecting parts remaining at each end of said blank; and deforming said divided parts of said central area of the blank into curved shapes for providing multicontacts.

5. A method according to claim 4, with the further step of cutting one connecting end part of said blank adjacent said cut through dents after the aforesaid deforming step for providing the multiple contact points thus providing flexible spring contact parts having free ends.

* * * * *

UNITED STATES PATENT AND TRADEMARK OFFICE

CERTIFICATE OF CORRECTION

PATENT NO. : 4,345,372

DATED : August 24, 1982

INVENTOR(S) : Kenji Sekigawa et al.

It is certified that error appears in the above—identified patent and that said Letters Patent is hereby corrected as shown below:

Column 3, line 44, "l" should read --ℓ--.

Signed and Sealed this

Fifth Day of April 1983

[SEAL]

*Attest:*

GERALD J. MOSSINGHOFF

*Attesting Officer*

*Commissioner of Patents and Trademarks*